US009898960B2

(12) United States Patent
Yang et al.

(10) Patent No.: US 9,898,960 B2
(45) Date of Patent: Feb. 20, 2018

(54) PIXEL CIRCUIT, ITS DRIVING METHOD, OLED DISPLAY PANEL AND OLED DISPLAY DEVICE

(71) Applicant: BOE TECHNOLOGY GROUP CO., LTD., Beijing (CN)

(72) Inventors: Fei Yang, Beijing (CN); Chen Zhang, Beijing (CN); Yue Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 331 days.

(21) Appl. No.: 14/646,258

(22) PCT Filed: Sep. 30, 2014

(86) PCT No.: PCT/CN2014/087929
§ 371 (c)(1),
(2) Date: May 20, 2015

(87) PCT Pub. No.: WO2015/180353
PCT Pub. Date: Dec. 3, 2015

(65) Prior Publication Data

US 2016/0253953 A1 Sep. 1, 2016

(30) Foreign Application Priority Data

May 30, 2014 (CN) ..... 2014 1 0241097

(51) Int. Cl.
*G09G 3/32* (2016.01)
*G09G 3/3208* (2016.01)
(Continued)

(52) U.S. Cl.
CPC ..... *G09G 3/3208* (2013.01); *G09G 3/2074* (2013.01); *G09G 3/3233* (2013.01);
(Continued)

(58) Field of Classification Search
CPC .. G09G 3/3208–3/34; G09G 2300/043; G09G 2320/0233; G09G 2320/045; G09G 2320/0626–2320/0653
See application file for complete search history.

(56) References Cited

U.S. PATENT DOCUMENTS

2010/0103156 A1* 4/2010 Yamashita ..... G09G 3/3233 345/211

FOREIGN PATENT DOCUMENTS

CN 1917019 A 2/2007
CN 101236719 A 8/2008
(Continued)

OTHER PUBLICATIONS

International Search Report and Written Opinion of the International Searching Authority for International Application No. PCT/CN2014/087929, dated Feb. 15, 2015. Translation provided by Dragon Intellectual Property Law Firm.
(Continued)

*Primary Examiner* — William Boddie
*Assistant Examiner* — Jeffrey A Parker
(74) *Attorney, Agent, or Firm* — Harness, Dickey & Pierce, P.L.C.

(57) ABSTRACT

The present disclosure provides a pixel circuit, its driving method, an OLED display panel and an OLED display device. The pixel circuit includes row pixel units each including subpixel units. The row pixel unit includes an auxiliary compensating circuit, which is configured to generate a switching control signal inputted to a subpixel driving circuit according to a scanning signal from a gate driving circuit, and generate a compensating control signal inputted to the subpixel driving circuit according to a control signal from the gate driving circuit. The subpixel driving circuit is configured to receive a data voltage from a data line
(Continued)

accordance to the switching control signal, control a driving transistor to drive an OLED to emit light according to the data voltage, and compensate for a threshold voltage of the driving transistor according to the compensating control signal when the driving transistor drives the OLED to emit light.

8 Claims, 5 Drawing Sheets

(51) Int. Cl.
*G09G 3/20* (2006.01)
*G09G 3/3233* (2016.01)

(52) U.S. Cl.
CPC ..... *G09G 2300/0852* (2013.01); *G09G 2320/045* (2013.01)

(56) References Cited

FOREIGN PATENT DOCUMENTS

| | | | |
|---|---|---|---|
| CN | 101266754 | A | 9/2008 |
| CN | 101493617 | A | 7/2009 |
| CN | 101727812 | A | 6/2010 |
| CN | 101727813 | A | 6/2010 |
| CN | 101493617 | B | 11/2010 |
| CN | 102654975 | A | 9/2012 |
| CN | 103714778 | A | 4/2014 |
| CN | 104036726 | A | 9/2014 |
| JP | 2008058446 | A | 3/2008 |
| KR | 100893481 | B1 | 4/2009 |

OTHER PUBLICATIONS

International Search Report and Written Opinion dated Feb. 15, 2015 regarding PCT/CN2014/087929. Translation provided by Dragon Intellectual Property Law Firm.

Chinese Office Action dated Dec. 31, 2014 regarding Chinese Application No. 201410241097.5. Translation provided by Dragon Intellectual Property Law Firm.

* cited by examiner

PIXEL CIRCUIT, ITS DRIVING METHOD, OLED DISPLAY PANEL AND OLED DISPLAY DEVICE

CROSS-REFERENCE TO RELATED APPLICATION

The present application is the U.S. national phase of PCT Application No. PCT/CN2014/087929 filed on Sep. 30, 2014, which claims a priority of the priority of the Chinese patent application No. 201410241097.5 filed on May 30, 2014, which is incorporated herein by reference in its entirety.

TECHNICAL FIELD

The present disclosure relates to the field of organic light-emitting diode (OLED) display technology, in particular to a pixel circuit, its driving method, an OLED display panel, and an OLED display device.

BACKGROUND

An OLED display panel can emit light when it is driven by a current generated by a driving thin film transistor (TFT) in a saturated state. When an identical grayscale voltage is applied, different driving currents will be generated by different critical voltages, which thus results in inconsistency of the currents. For example, a traditional 2T1C-based pixel driving circuit is always of a less brightness evenness, and currently, such a solution is adopted so as to add a compensating circuit within a pixel, and eliminate an effect of a threshold voltage Vth of the driving TFT by the compensating circuit. However, usually an increase in the number of the TFTs will lead to a rapid decrease in an aperture ratio and an increase in the production cost. In the case of an identical pixel driving current, there exits not necessarily a decrease in the brightness of the OLED display panel with a low aperture ration, but a current density of an organic light-emitting layer will certainly increase, which will readily result in aging of a material of the light-emitting layer, and thereby result in a short service life of the entire OLED display panel.

SUMMARY

A main object of the present disclosure is to provide a pixel circuit, its driving method, an OLED display panel and an OLED display device, so as to simplify the design of the pixel circuit and increase an aperture ratio of pixels, thereby to increase a current density of an organic light-emitting layer while acquiring even display brightness.

In order to achieve the above object, the present disclosure provides a pixel circuit for use in an OLED display panel, including a plurality of row pixel units. One of the row pixel units includes a plurality of subpixel units, and one of the subpixel units includes a subpixel driving circuit and an OLED. The subpixel driving circuit includes a driving transistor which is connected to the OLED, and a driving control module connected to a data line and the driving transistor. The one of row pixel units further includes an auxiliary compensating circuit.

An input end of the auxiliary compensating circuit is connected to a gate driving circuit of the OLED display panel via an auxiliary scanning line; and an output end thereof is connected to the subpixel driving circuit of the one of the row pixel units via a scanning line. The auxiliary compensating circuit is configured to generate a switching control signal inputted to the subpixel driving circuit according to a scanning signal from the gate driving circuit, and generate a compensating control signal inputted to the subpixel driving circuit according to a control signal from the gate driving circuit.

The subpixel driving circuit is configured to receive a data voltage from the data line accordance to the switching control signal, control the driving transistor to drive the OLED to emit light according to the data voltage, and compensate for a threshold voltage of the driving transistor according to the compensating control signal when the driving transistor drives the OLED to emit light.

During the implementation, each of the row pixel units includes a plurality of sub-pixel units; each of the subpixel units includes the subpixel driving circuit and the OLED; each of the row pixel units includes the auxiliary compensating circuit; and the output end of the auxiliary compensating circuit is connected to each subpixel driving circuit of each of the row pixel units via a scanning line.

During the implementation, the auxiliary compensating circuit is arranged outside of an effective display region of the OLED display panel, and the subpixel unit is arranged within the effective display region of the OLED display panel.

During the implementation, a driving power receiving end of the auxiliary compensating circuit is connected to a driving power signal line, and a resetting power receiving end thereof is connected to a resetting power signal line. The auxiliary compensating circuit is configured to generate the compensating control signal according to a driving voltage signal from the driving power signal line, a resetting voltage signal from the resetting power signal line and the control signal from the gate driving circuit.

The driving power signal line and the resetting power signal line are both arranged outside of the effective display region of the OLED display panel.

During the implementation, a first electrode of the driving transistor is connected to an anode of the OLED, and a second electrode thereof is configured to receive the compensating control signal. A cathode of the OLED is configured to receive a cathode potential.

The driving control module includes:

a data writing-in transistor, a gate electrode of which is configured to receive the switching control signal, a first electrode of which is connected to the data line, and a second electrode of which is connected to a gate electrode of the driving transistor;

a first capacitor, one end of which is connected to the gate electrode of the driving transistor, and another end of which is connected to the first electrode of the driving transistor; and a second capacitor connected between the anode and the cathode of the OLED.

During the implementation, the control signal includes a driving control signal and a resetting control signal. The resetting control signal is delayed by two clock periods relative to the driving control signal. The auxiliary compensating circuit includes a switching control signal generating circuit and a compensating control signal generating circuit. The switching control signal generating circuit is configured to directly use the scanning signal from the gate driving circuit as the switching control signal inputted to the gate electrode of the data writing-in transistor.

The compensating control signal generating circuit includes:

a first compensating transistor, a gate electrode of which is configured to receive the driving control signal, and a first electrode of which is configured to receive the resetting voltage signal;

a second compensating transistor, a gate electrode of which is connected to a second electrode of the first compensating transistor, and a first electrode of which is configured to receive the resetting voltage signal;

a third compensating transistor, a gate electrode of which is configured to receive the driving control signal, a first electrode of which is connected to a second electrode of the second compensating transistor, and a second electrode of which is configured to receive the driving voltage signal;

a fourth compensating transistor, a gate electrode of which is configured to receive the resetting control signal, a first electrode of which is connected to the gate electrode of the second compensating transistor, and a second electrode of which is configured to receive the resetting control signal; and a fifth compensating transistor, a gate electrode of which is connected to the gate electrode of the second compensating transistor, a first electrode of which is connected to the first electrode of the fourth compensating transistor, and a second electrode of which is connected to the second electrode of the fourth compensating transistor.

A signal outputted from the first electrode of the third compensating transistor is the compensating control signal. The first electrode of the third compensating transistor is connected to the second electrode of the driving transistor.

During the implementation, the control signal includes a driving control signal and a resetting control signal. The auxiliary compensating circuit includes a switching control signal generating circuit and a compensating control signal generating circuit. The switching control signal generating circuit is configured to directly use the scanning signal from the gate driving circuit as the switching control signal inputted to the gate electrode of the data writing-in transistor.

The compensating control signal generating circuit includes:

a first compensating control transistor, a gate electrode of which is configured to receive the resetting control signal, and a first electrode of which is connected to receive the resetting voltage signal; and a second compensating control transistor, a gate electrode of which is configured to receive the driving control signal, a first electrode of which is connected to a second electrode of the first compensating control transistor, and a second electrode of which is configured to receive the driving voltage signal.

A signal outputted from the second electrode of the first compensating control transistor is the compensating control signal, and the second electrode of the first compensating control transistor is connected to the second electrode of the driving transistor.

The present disclosure further provides a pixel circuit driving method for use in the above-mentioned pixel circuit, including:

an initial light-emitting step: at an initial light-emitting state, a driving control signal is a high level signal, a resetting control signal is a high level signal, a scanning signal is a low level signal, a compensating control signal generated by an auxiliary compensating circuit is a high level signal, a switching control signal generated by the auxiliary compensating circuit is a low level signal, a data writing-in transistor is turned off, a potential at a gate electrode of a driving transistor is a voltage stored in a previous frame, and an OLED emits light;

a resetting step: at a resetting stage, the driving control signal is a low level signal, the resetting control signal is a high level signal, the scanning signal is a high level signal, the compensating control signal generated by the auxiliary compensating circuit is a low level signal, the switching control signal generated by the auxiliary compensating circuit is a high level signal, a reference voltage on a data line is written into the gate electrode of the driving transistor, the driving transistor is turned on, and a potential at an anode of the OLED is reset to be at a low level, and the OLED does not emit light;

a compensating step: at a compensating stage, the driving control signal is a high level signal, the resetting control signal is a high level signal, a scanning signal is a high level signal, the compensating control signal generated by the auxiliary compensating circuit is a high level signal, the switching control signal generated by the auxiliary compensating circuit is a high level signal, the reference voltage on the data line is written into the gate electrode of the driving transistor, and a potential at a source electrode of the driving transistor gradually increases to a value obtained by subtracting a threshold voltage of the driving transistor from the reference voltage on the data line, so as to compensate for the threshold voltage of the driving transistor with a gate-to-source voltage of the driving transistor, and the OLED does not emit light;

a data writing-in step: at a data writing-in stage, the driving control signal is a low level signal, the resetting control signal is a low level signal, the scanning signal is a high level signal, the compensating control signal generated by the auxiliary compensating circuit is a floating signal, the switching control signal generated by the auxiliary compensating circuit is a high level signal, a data voltage is written into the gate electrode of the driving transistor, the driving transistor is turned on, and the OLED does not emit light; and a light-emitting step: at a light-emitting stage, the driving control signal is a high level signal, the resetting control signal is a high level signal, the scanning signal is a low level signal, the compensating control signal generated by the auxiliary compensating circuit is a high level signal, the switching control signal generated by the auxiliary compensating circuit is a low level signal, a voltage difference between two ends of a first capacitor remains unchanged so as to maintain the gate-to-source voltage of the driving transistor as unchanged, and the driving transistor is turned on so as to drive the OLED to emit light.

The present disclosure further provides an OLED display panel including the above-mentioned pixel circuit.

The present disclosure provides in one embodiment an OLED display device including the above-mentioned OLED display panel.

As compared with the related art, the auxiliary compensating circuit is shared in the present disclosure by the pluralities of subpixel units in the row pixel unit, so it is able to simplify the design of the pixel circuit and remarkably increase the aperture ratio of the pixels, thereby to reduce the current density of the organic light-emitting layer while acquiring the even display brightness, and to prolong a service life of the OLED display panel. In addition, due to a decrease in the number of the TFTs, it is able to reduce the production cost.

DETAILED DESCRIPTION

Figure 1A:
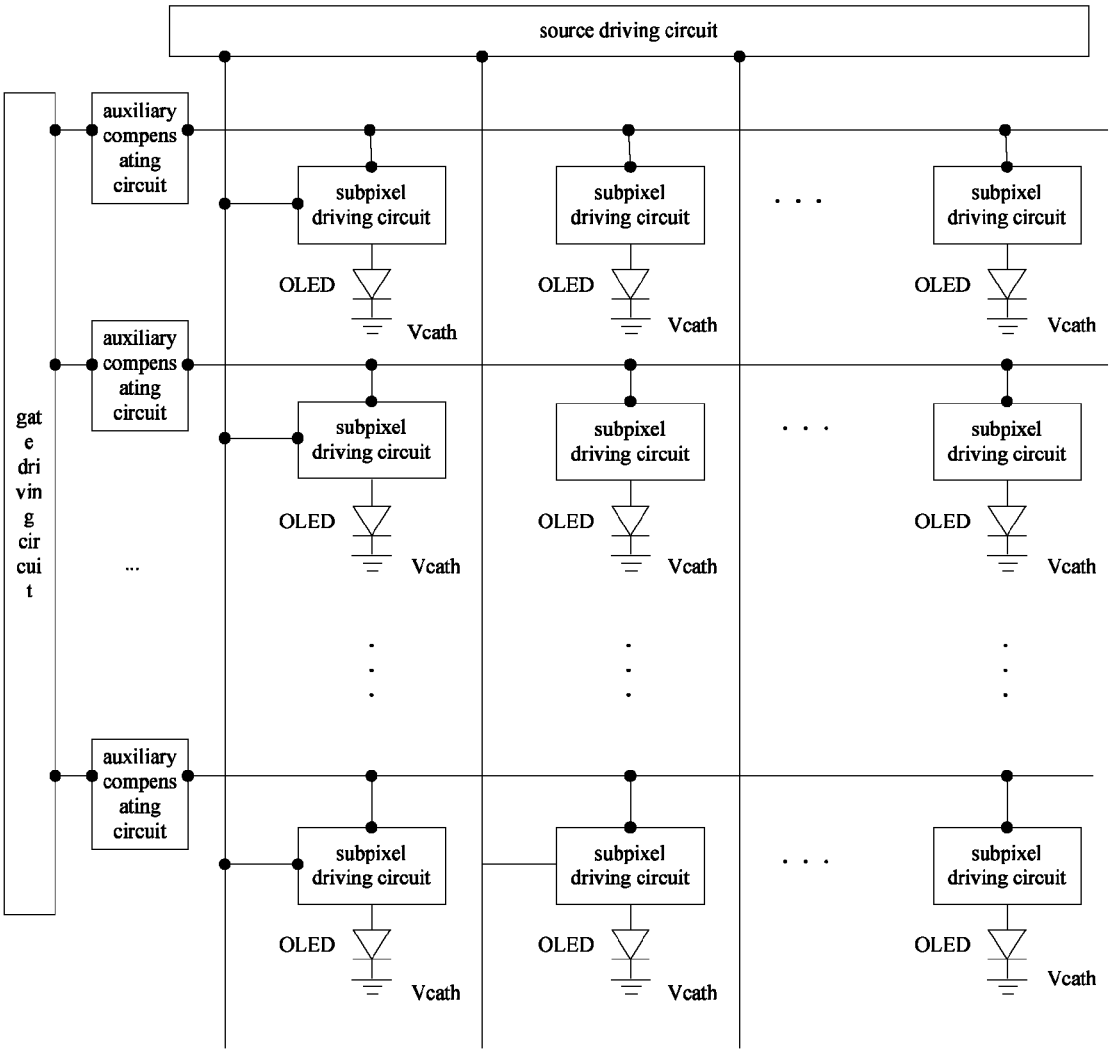
FIG. 1A is a schematic view showing an OLED display panel to which a pixel circuit is applied according to one embodiment of the present disclosure.

The technical solutions in embodiments of the present disclosure will be described hereinafter in conjunction with the drawings in a clear and complete manner. Obviously, the following embodiments merely relate to a part of, rather than all of, the embodiments of the present disclosure. Based on these embodiments, a person skilled in the art may obtain other embodiments without any creative effort, which also fall within the scope of the present disclosure.

The present disclosure provides in one embodiment a pixel circuit for use in an OLED display panel, including a plurality of row pixel units. Each row pixel unit includes a plurality of subpixel units. Each subpixel unit includes a subpixel driving circuit and an OLED. The subpixel driving circuit includes a driving transistor coupled with the OLED, and a driving control module which is coupled with a data line and the driving transistor. Each row pixel unit further includes an auxiliary compensating circuit.

An input end of the auxiliary compensating circuit is connected to a gate driving circuit of the OLED display panel via an auxiliary scanning line. An output end of the auxiliary compensating circuit is connected to the subpixel driving circuit of the row pixel unit. The auxiliary compensating circuit is configured to generate a switching control signal inputted to the subpixel driving circuit according to a scanning signal from the gate driving circuit, and generate a compensating control signal inputted to the subpixel driving circuit according to a control signal from the gate driving circuit.

The subpixel driving circuit is configured to receive a data voltage from the data line accordance to the switching control signal, control the driving transistor to drive the OLED to emit light according to the data voltage, and compensate for a threshold voltage of the driving transistor according to the compensating control signal when the driving transistor drives the OLED to emit light.

According to the pixel circuit in the embodiment of the present disclosure, the auxiliary compensating circuit is shared by the plurality of subpixel units in the row pixel unit, so it is able to simplify the design of the pixel circuit and remarkably increase an aperture ratio of pixels, thereby to reduce a current density of an organic light-emitting layer while acquiring the even display brightness, and to prolong a service life of the OLED display panel. In addition, due to a decrease in the number of the TFTs, it is able to reduce the production cost.

Alternatively, the auxiliary compensating circuit is arranged outside of an effective display region of the OLED display panel, and the subpixel units are arranged within the effective display region of the OLED display panel, so as to further reduce the number of the TFTs within the effective display region, thereby to increase the aperture ratio of the pixels.

During the implementation, a driving power receiving end of the auxiliary compensating circuit is connected to a driving power signal line; and a resetting power receiving end of the auxiliary compensating circuit is connected to a resetting power signal line. The auxiliary compensating circuit is configured to generate the compensating control signal according to a driving voltage signal from the driving power signal line, a resetting voltage signal from the resetting power signal line and the control signal from the gate driving circuit.

The driving power signal line and the resetting power signal line are both arranged outside of the effective display region of the OLED display panel.

To be specific, as shown in FIG. 1A, the OLED display panel to which the pixel circuit is applied includes a source driving circuit and a gate driving circuit. The pixel circuit includes a plurality of row pixel units, each row pixel unit includes a plurality of subpixel units, and the subpixel unit includes a subpixel driving circuit and an OLED. The subpixel driving circuit is connected to an anode of the OLED, and a cathode of the OLED is configured to receive a cathode potential Vcath. The source driving circuit is connected to the subpixel driving circuit via a data line.

The row pixel unit further includes an auxiliary compensating circuit. An input end of the auxiliary compensating circuit is connected to the gate driving circuit via an auxiliary scanning line. An output end of the auxiliary compensating circuit is connected to the subpixel driving circuit of the row pixel unit via a scanning line. The source driving circuit is configured to transmit a data voltage and a reference voltage to the subpixel driving circuit via a data line.

The auxiliary compensating circuit is configured to generate a switching control signal according to a scanning signal from the gate driving circuit, generate a compensating control signal according to a control signal from the gate driving circuit, a driving voltage signal from the driving power signal line and a resetting voltage signal from the resetting power signal line, and transmit the switching control signal and the compensating control signal to the subpixel driving circuit via the scanning line. The auxiliary scanning line is configured to transmit a signal between the gate driving circuit and the auxiliary compensating circuit.

The subpixel driving circuit is configured to receive the data voltage from the data line according to the switching control signal, control the driving transistor to drive the OLED to emit light with different brightness values according to the data voltage, and compensate for the threshold voltage of the driving transistor according to the compensating control voltage when the driving transistor drives the OLED to emit light.

Alternatively, each row pixel unit includes a plurality of subpixel units, each subpixel unit includes a subpixel driving circuit and an OLED, and each row pixel unit includes the auxiliary compensating circuit. An output end of the auxiliary compensating circuit is connected to each subpixel driving circuit of the row pixel unit via the scanning line.

Figure 1B:
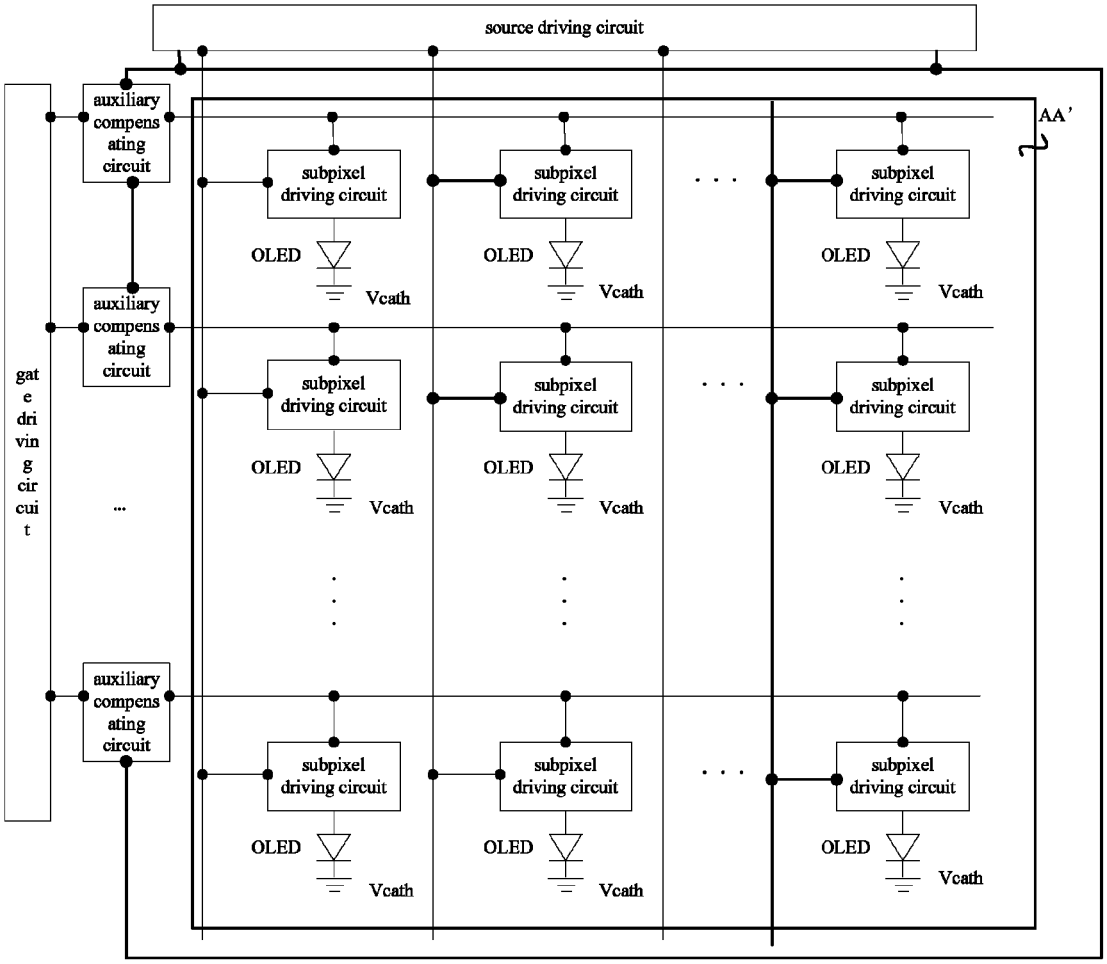
FIG. 1B is another schematic view showing the OLED display panel to which the pixel circuit is applied according to one embodiment of the present disclosure.

In a specific embodiment, on the basis of the OLED display panel in FIG. 1A, as shown in FIG. 1B, the auxiliary compensating circuit is arranged outside of an effective display region AA' of the OLED display panel, and the subpixel unit is arranged within the effective display region AA' of the OLED display panel.

The OLED display panel further includes a power signal line arranged outside of the effective display region AA' and connected to the source driving circuit, the gate driving circuit and the auxiliary compensating circuit, respectively. The power signal line is configured to be controlled by the source driving circuit or the gate driving circuit, so as to provide a corresponding power signal to the auxiliary compensating circuit.

To be specific, the power signal line includes a driving power signal line and a resetting power signal line. A driving power receiving end of the auxiliary compensating circuit is connected to the driving power signal line. A resetting power receiving end of the auxiliary compensating circuit is connected to the resetting power signal line. The auxiliary compensating circuit is specifically configured to generate the compensating control signal according to a driving voltage signal from the driving power signal line, a resetting voltage signal from the resetting power signal line and the control signal from the gate driving circuit.

The driving power signal line and the resetting power signal line are arranged outside of the effective display region of the OLED display panel, so as to reduce the number of the signal lines within the effective display region.

The transistor adopted in all the embodiments of the present disclosure may be a thin film transistor, a field effect transistor or any other element having the same characteristics. In this embodiment, in order to differentiate two electrodes of the transistor other than the gate electrode, one is called as a source electrode and the other is called as a drain electrode. In addition, depending on its characteristics, the transistor may include an n-type or p-type transistor. In the driving circuit of this embodiment, all the transistors being n-type transistors is taken as an example for illustration. Of course, the p-type transistors may also be used, which also falls within in the scope of the present disclosure.

In the embodiment of the present disclosure, for the n-type transistor, the first electrode is a source electrode and the second electrode is a drain electrode, while for the p-type transistor, the first electrode is a drain electrode and the second electrode is a source electrode.

The subpixel driving circuit in an N-th row and an M-th column as well as the auxiliary compensating circuit in an N-th row included in the pixel circuit (N is a positive integer greater than or equal to 1, and M is a positive integer greater than or equal to 1) will be described hereinafter.

Figure 2A:
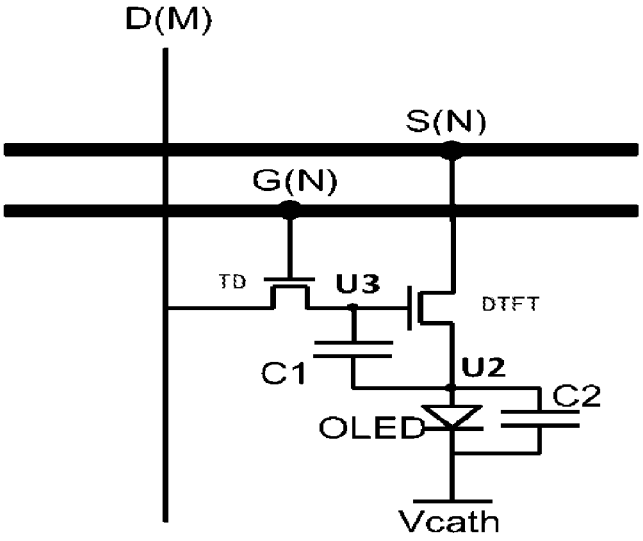
FIG. 2A is a schematic view showing a subpixel driving circuit in an N-th row and an M-th column included in the pixel circuit according to one embodiment of the present disclosure.

As shown in FIG. 2A, the subpixel driving circuit in the N-th row and the M-th column include a driving transistor DTFT, a data writing-in transistor TD, a first capacitor C1, a second capacitor C2 and an organic light-emitting diode (OLED).

A first electrode of the driving transistor DTFT is connected to an anode of the OLED. A second electrode of the driving transistor DTFT is configured to receive a compensating control signal S(N). A cathode of the OLED is configured to receive a cathode potential Vcath.

A gate electrode of the data writing-in transistor TD is configured to receive a switching control signal G(N). A first electrode of the data writing-in transistor TD is connected to a data line D(M) in an M-th column. A second electrode of the data writing-in transistor TD is connected to a gate electrode of the driving transistor DTFT.

One end of the first capacitor C1 is connected to the gate electrode of the driving transistor DTFT, and the other end thereof is connected to the first electrode of the driving transistor DTFT.

The second capacitor C2 is connected between the anode and the cathode of the OLED.

DTFT and TD are both n-type TFTs.

A node U2 is connected to the first electrode of DTFT, and a node U3 is connected to the gate electrode of DTFT.

Figure 2B:
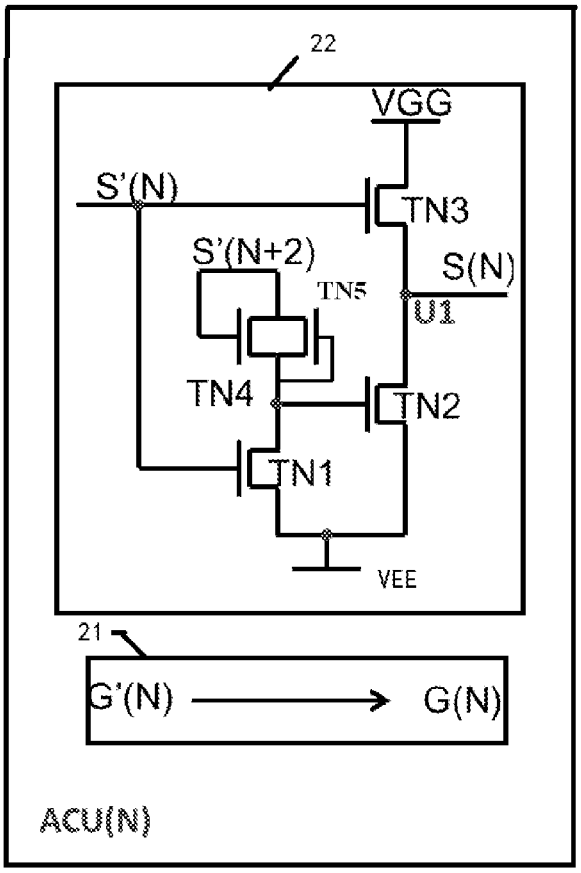
FIG. 2B is a schematic view showing an auxiliary compensating circuit ACU(N) in an N-th row included in the pixel circuit according to one embodiment of the present disclosure.

In a specific embodiment, as shown in FIG. 2B, the control signal includes a driving control signal S'(N) and a resetting control signal S'(N+2). The resetting control signal S'(N+2) is delayed by two clock periods relative to the driving control signal S'(N).

The auxiliary compensating circuit ACU(N) in an N-th row includes a switching control signal generating circuit 21 and a compensating control signal generating circuit 22.

The switching control signal generating circuit 21 is configured to directly use a scanning signal G'(N) from the gate driving circuit as the switching control signal G(N) inputted to the gate electrode of the data writing-in transistor TD.

As shown in FIG. 2B, the compensating control signal generating circuit 22 includes:

a first compensating transistor TN1, a gate electrode of which is configured to receive the driving control signal S'(N), and a first electrode of which is configured to receive a resetting voltage signal VEE;

a second compensating transistor TN2, a gate electrode of which is connected to a second electrode of the first compensating transistor TN1, and a first electrode of which is configured to receive the resetting voltage signal VEE;

a third compensating transistor TN3, a gate electrode of which is configured to receive the driving control signal S'(N), a first electrode of which is connected to a second electrode of the second compensating transistor TN2, and a second electrode of which is configured to receive a driving voltage signal VGG;

a fourth compensating transistor TN4, a gate electrode of which is configured to receive the resetting control signal S'(N+2), a first electrode of which is connected to the gate electrode of the second compensating transistor TN2, and a second electrode is configured to receive the resetting control signal S'(N+2); and a fifth compensating transistor TN5, a gate electrode of which is connected to the gate electrode of the second compensating transistor TN2, a first electrode of which is connected to the first electrode of the fourth compensating transistor TN4, and a second electrode of which is connected to the second electrode of the fourth compensating transistor TN4.

TN4 and TN5 together function as a resistor with a relatively large resistance.

A signal outputted from the first electrode of the third compensating transistor TN3 is the compensating control signal S(N), and a node U1 is connected to the first electrode of the third compensating transistor TN3. The first electrode of the third compensating transistor TN3 is connected to the second electrode of the driving transistor DTFT. The driving voltage signal VGG is at a high potential, and the resetting voltage signal VEE is at a low potential.

Figure 3:
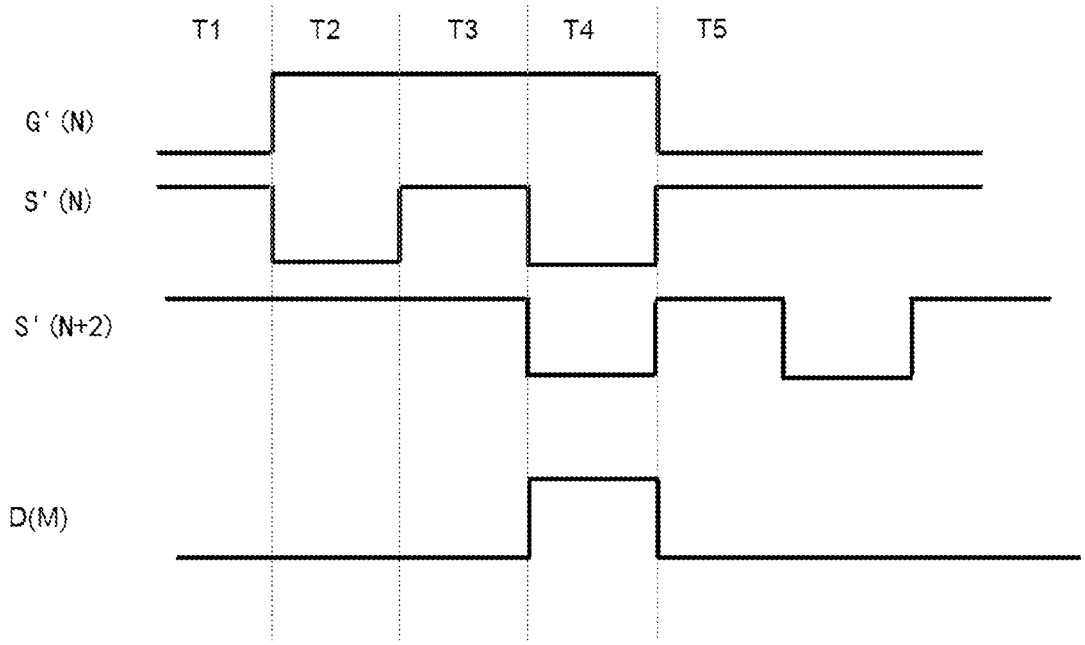
FIG. 3 is a working timing sequence diagram of a pixel driving compensating circuit composed of the subpixel driving circuit in the N-th row and the M-th column in FIG. 2A and the auxiliary compensating circuit ACU(N) in the N-th row in FIG. 2B.

FIG. 3 is a working timing sequence diagram of a pixel driving compensating circuit composed of the subpixel driving circuit in the N-th row and the M-th column in FIG. 2A and the auxiliary compensating circuit ACU(N) in the N-th row in FIG. 2B. As shown in FIG. 3, a working procedure of the pixel driving compensating circuit may include following five stages.

At an initial light-emitting stage T1, S'(N) and S'(N+2) are both at a high potential VGH, TN1 and TN3 are turned on, TN2 is turned off due to an on state of TN1, at this time, S(N) is the driving voltage signal VGG; G'(N) is at a low potential VGL and directly transmitted to G(N) in the auxiliary compensating unit ACU(N) without any signal conversion, and TD is turned off; at this time, the potential of the node U3 is a voltage stored in a previous frame, and the OLED emits light normally.

At a resetting stage T2, S'(N) is at the low potential VGL, TN1 and TN3 are turned off; S'(N+2) is at the high potential VGH, TN2 is turned on, and at this time, S(N) is the resetting voltage signal VEE; G'(N) and G(N) are both at the high potential VGH, TD is turned on, a reference voltage Vref on D(M) is applied to the gate electrode of DTFT; at this time, the potential of the node U3 is Vref which is greater than the threshold voltage Vth of DTFT, so DTFT is turned on; the potential of the node U2 is the potential of the resetting voltage signal VEE, and a difference between the potential of VEE and Vcath is less than an on-state voltage Voled of the OLED, so the OLED does not emit light.

At a compensating stage T3, S'(N) and S'(N+2) are both at the high potential VGH, TN1 and TN3 are turned on, TN2 is turned off due to the on state of TN1, and at this time, S(N) is the driving voltage signal VGG; G'(N) and G(N) are both at the high potential VGH, TD is turned on, and the reference voltage Vref on D(M) is applied to the gate electrode of DTFT; at this time, the potential of the node U3 is Vref, and DTFT is initially turned on. The potential of the node U2 (i.e., the potential at the source electrode of DTFT) gradually increases from the potential of the resetting voltage signal VEE to Vref-Vth, and when the potential of the node U2 reaches Vref-Vth, DTFT is turned off. Because Vref-Vth-Vcath is less than the on-state voltage Voled of the OLED, so the OLED does not emit light.

At a data writing-in stage T4, S'(N) and S'(N+2) are both at the low potential VGL, TN1, TN2 and TN3 are turned off, and at this time, S(N) is in a floating state. G'(N) and G(N) are both at the high potential VGH, TD is turned on, and the data voltage Vdata on D(M) is applied to the gate electrode of the DTFT so as to turn on the DTFT. At this time, the potential of the node U3 is Vdata, and the potential of the node U2 is Vref−Vth+a*(Vdata−Vref) (at this time a potential variation of the node U3 is Vdata−Vref, so a potential variation of the U2 is a*(Vdata−Vref) due to voltage division of the capacitor), where a=C1/(C1+C2), C1 is a capacitance of the first capacitor, and C2 is a capacitance of the second capacitor. At this time, S(N) is in the floating state, so the OLED does not emit light.

At a light-emitting stage T5, S'(N) and S'(N+2) are both at the high potential VGH, TN1 and TN3 are both turned on, TN2 is turned off due to the on state of TN1, and at this time, S(N) is the driving voltage signal VGG. G'(N) and G(N) are both at the low potential VGL, TD is turned off, and a voltage difference between two ends of the first capacitor remains unchanged due to an off-state of TD.

The on-state voltage of the OLED is Voled, and at this time, the potential of the node U2 is Voled+Vcath, a potential variation of the node U2 is Vref−Vth+a*(Vdata−Vref)−Voled−Vcath, and the potential of the node U3 is (1−a)*(Vdata−Vref)+Vth+Voled+Vcath.

A potential difference Vgs between the node U3 and the node U2 is Vgs=(1−a)*(Vdata−Vref)+Vth+Voled+Vcath−(Voled+Vcath)=(1−a)*(Vdata−Vref)+Vth.

A current passing through DTFT at the light-emitting stage is $$I_{OLED} = \frac{1}{2}\mu_n \times Cox \times \frac{W}{L} \cdot (Vgs - Vth)^2 = \frac{1}{2}\mu_n \times Cox \times \frac{W}{L} \times ((1-a) \times (Vdata - Vref) + Vth - Vth)^2 = \frac{1}{2}\mu_n \times Cox \cdot \frac{W}{L} \times ((1-a) \times (Vdata \times Vref)^2,$$

where $\mu_n$ represents carrier mobility, $C_{OX}$ represents a capacitance of a gate oxide, W/L is a width to length ratio of DTFT, and Vcath is a cathode potential of the OLED.

As can be seen from the above formula, the current passing through DTFT is merely relevant to Vdata and Vref, but irrelevant to the threshold voltage Vth of DTFT and the on-state voltage Voled of the OLED. Even if Vth is less than 0, it is still able to perform the compensation in a better manner. As a result, it is able to compensate for the uneven brightness of the OLED in a better manner, thereby to achieve a desired effect.

According to the pixel circuit in the embodiment of the present disclosure, the design of the internal compensating circuit is simplified, so as to reduce the number of the signal lines. As a result, it is able to increase the aperture ratio of the pixels, prolong the service life of the OLED, simplify a compensation waveform of the compensating circuit, reduce the integration and reduce the number of the used TFTs, thereby to effectively reduce the production cost.

Figure 4:
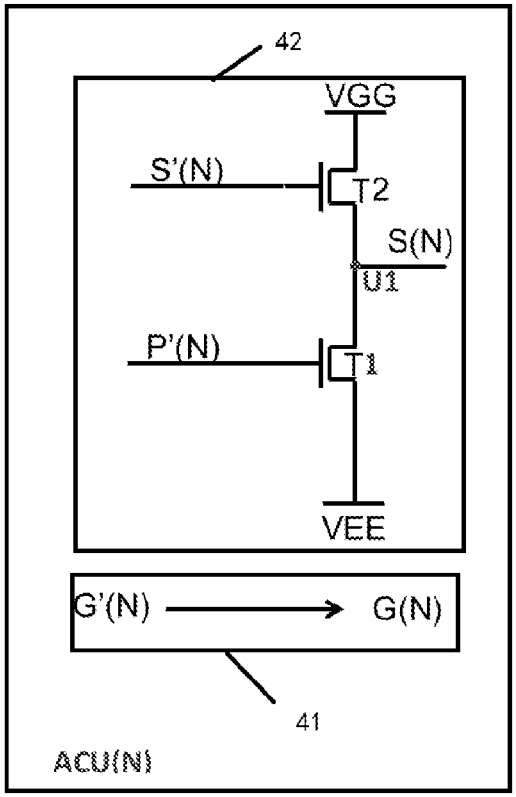
FIG. 4 is a schematic view showing an auxiliary compensating circuit ACU(N) in an N-th row included a pixel circuit according to another embodiment of the present disclosure.

In a specific embodiment, as shown in FIG. 4, the control signal includes a driving control signal S'(N) and a resetting control signal P'(N).

The auxiliary compensating circuit ACU(N) in an N-th row includes a switching control signal generating circuit 41 and a compensating control signal generating circuit 42.

The switching control signal generating circuit 41 is configured to directly use a scanning signal G'(N) from the gate driving circuit as the switching control signal G(N) inputted to the gate electrode of the data writing-in transistor TD.

As shown in FIG. 4, the compensating control signal generating circuit 42 includes:

a first compensating control transistor T1, a gate electrode of which is configured to receive the resetting control signal P'(N), and a first electrode of which is configured to receive the resetting voltage signal VEE; and a second compensating control transistor T2, a gate electrode of which is configured to receive the driving control signal S'(N), a first electrode of which is connected to a second electrode of the first compensating control transistor T1, and a second electrode of which is configured to receive the driving voltage signal VGG.

A signal outputted from the second electrode of the first compensating control transistor T1 is the compensating control signal S(N), and the node U1 is connected to the second electrode of the first compensating control transistor T1. The second electrode of the first compensating control transistor T1 is connected to the second electrode of the driving transistor DTFT. The driving voltage signal VGG is at a high potential, and the resetting voltage signal VEE is at a low potential.

Figure 5:
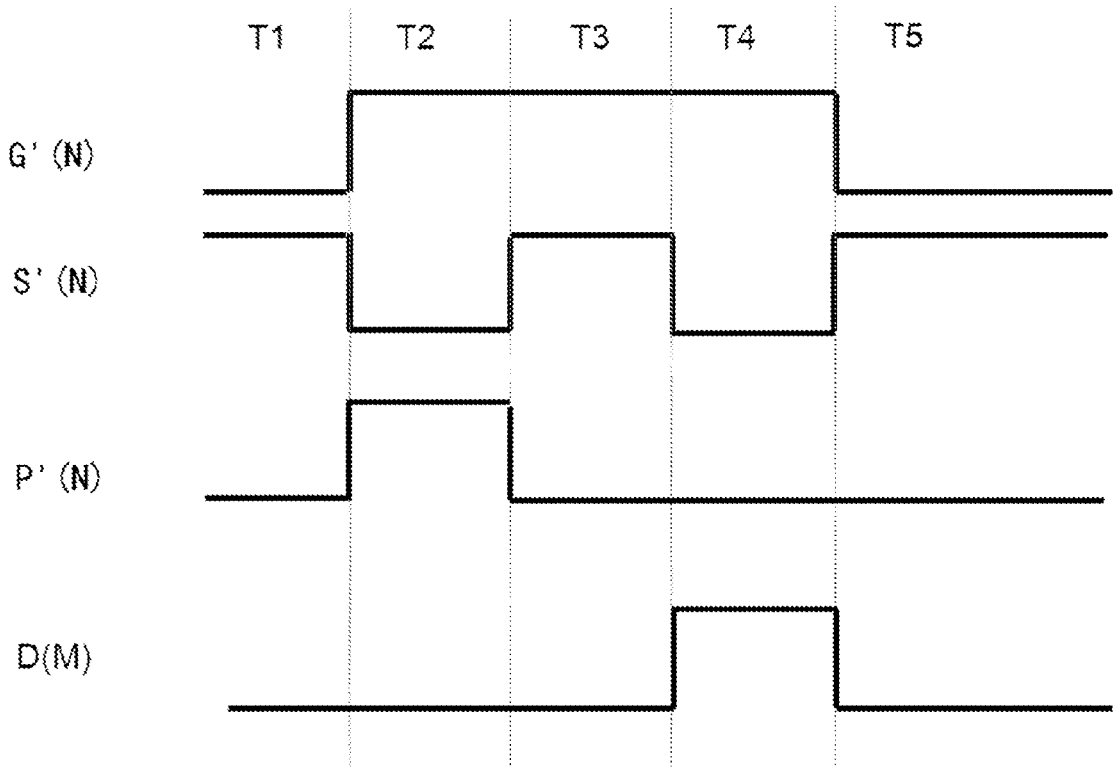
FIG. 5 is a working timing sequence diagram of a pixel driving compensating circuit composed of the subpixel driving circuit in the N-th row and the M-th column in FIG. 2A and the auxiliary compensating circuit ACU(N) in the N-th row in FIG. 4.

FIG. 5 is a working timing sequence diagram of the pixel driving compensating circuit composed of the subpixel driving circuit in the N-th row and the M-th column in FIG. 2A and the auxiliary compensating circuit ACU(N) in the N-th row in FIG. 4.

The subpixel driving circuit is not limited to the above-mentioned structure, and the auxiliary compensating circuit is not limited to the above structure too.

The present disclosure further provides in one embodiment a pixel circuit driving method for use in the above-mentioned pixel circuit. The pixel circuit driving method includes:

an initial light-emitting step: at an initial light-emitting state, a driving control signal is a high level signal, a resetting control signal is a high level signal, a scanning signal is a low level signal, a compensating control signal generated by an auxiliary compensating circuit is a high level signal, a switching control signal generated by the auxiliary compensating circuit is a low level signal, a data writing-in transistor is turned off, a potential at a gate electrode of a driving transistor is a voltage stored in a previous frame, and an OLED emits light;

a resetting step: at a resetting stage, the driving control signal is a low level signal, the resetting control signal is a high level signal, the scanning signal is a high level signal, the compensating control signal generated by the auxiliary compensating circuit is a low level signal, the switching control signal generated by the auxiliary compensating circuit is a high level signal, a reference voltage Vref on a data line is written into the gate electrode of the driving transistor, the driving transistor is turned on, and a potential at an anode of the OLED is reset to be at a low level, and the OLED does not emit light;

a compensating step: at a compensating stage, the driving control signal is a high level signal, the resetting control signal is a high level signal, a scanning signal is a high level signal, the compensating control signal generated by the auxiliary compensating circuit is a high level signal, the switching control signal generated by the auxiliary compensating circuit is a high level signal, the reference voltage Vref on the data line is written into the gate electrode of the driving transistor, and a potential at a source electrode of the driving transistor gradually increases to Vref−Vth, so as to compensate for the threshold voltage Vth of the driving transistor with a gate-to-source voltage of the driving transistor, and the OLED does not emit light;

a data writing-in step: at a data writing-in stage, the driving control signal is a low level signal, the resetting control signal is a low level signal, the scanning signal is a high level signal, the compensating control signal generated by the auxiliary compensating circuit is a floating signal, the switching control signal generated by the auxiliary compensating circuit is a high level signal, a data voltage Vdata is written into the gate electrode of the driving transistor, the driving transistor is turned on, and the OLED does not emit light; and a light-emitting step: at a light-emitting stage, the driving control signal is a high level signal, the resetting control signal is a high level signal, the scanning signal is a low level signal, the compensating control signal generated by the auxiliary compensating circuit is a high level signal, the switching control signal generated by the auxiliary compensating circuit is a low level signal, a voltage difference between two ends of a first capacitor remains unchanged so as to maintain the gate-to-source voltage of the driving transistor as unchanged, and the driving transistor is turned on so as to drive the OLED to emit light.

The present disclosure further provides an OLED display panel including the above-mentioned pixel circuit.

The present disclosure further provides an OLED display device including the above-mentioned OLED display panel.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pixel circuit for use in an organic light-emitting diode (OLED) display panel, comprising a plurality of row pixel units, wherein:

one of the row pixel units comprises a plurality of subpixel units;

one of the subpixel units comprises a subpixel driving circuit and an OLED;

the subpixel driving circuit comprises a driving transistor connected to the OLED and a driving control module, which is connected to a data line and the driving transistor;

the one of the row pixel units further comprises an auxiliary compensating circuit;

an input end of the auxiliary compensating circuit is connected to a gate driving circuit of the OLED display panel via an auxiliary scanning line;

an output end of the auxiliary compensating circuit is connected to the subpixel driving circuit of the one of the row pixel units via a scanning line;

the auxiliary compensating circuit is configured to generate a switching control signal inputted to the subpixel driving circuit according to a scanning signal from the gate driving circuit, and generate a compensating control signal inputted to the subpixel driving circuit according to a control signal from the gate driving circuit;

the subpixel driving circuit is configured to receive a data voltage from the data line accordance to the switching control signal, control the driving transistor to drive the OLED to emit light according to the data voltage, and compensate for a threshold voltage of the driving transistor according to the compensating control signal when the driving transistor drives the OLED to emit light;

a driving power receiving end of the auxiliary compensating circuit is connected to a driving power signal line;

a resetting power receiving end of the auxiliary compensating circuit is connected to a resetting power signal line;

the auxiliary compensating circuit is configured to generate the compensating control signal according to a driving voltage signal from the driving power signal line, a resetting voltage signal from the resetting power signal line and the control signal from the gate driving circuit;

the driving power signal line and the resetting power signal line are both arranged outside of the effective display region of the OLED display panel;

a first electrode of the driving transistor is connected to an anode of the OLED;

a second electrode of the driving transistor is configured to receive the compensating control signal;

a cathode of the OLED is configured to receive a cathode potential;

the driving control module comprises a data writing-in transistor, a gate electrode of which is configured to receive the switching control signal, a first electrode of which is connected to the data line, and a second electrode of which is connected to a gate electrode of the driving transistor, a first capacitor, one end of which is connected to the gate electrode of the driving transistor, and another end of which is connected to the first electrode of the driving transistor, and a second capacitor connected between the anode and the cathode of the OLED;

the control signal comprises a driving control signal and a resetting control signal;

the resetting control signal is delayed by two clock periods relative to the driving control signal;

the auxiliary compensating circuit comprises a switching control signal generating circuit and a compensating control signal generating circuit;

the switching control signal generating circuit is configured to directly use the scanning signal from the gate driving circuit as the switching control signal inputted to the gate electrode of the data writing-in transistor;

the compensating control signal generating circuit comprises a first compensating transistor, a gate electrode of which is configured to receive the driving control signal, and a first electrode of which is configured to receive the resetting voltage signal, a second compensating transistor, a gate electrode of which is connected to a second electrode of the first compensating transistor, and a first electrode of which is configured to receive the resetting voltage signal, a third compensating transistor, a gate electrode of which is configured to receive the driving control signal, a first electrode of which is connected to a second electrode of the second compensating transistor, and a second electrode of which is configured to receive the driving voltage signal, a fourth compensating transistor, a gate electrode of which is configured to receive the resetting control signal, a first electrode of which is connected to the gate electrode of the second compensating transistor, and a second electrode of which is configured to receive the resetting control signal, and a fifth compensating transistor, a gate electrode of which is connected to the gate electrode of the second compensating transistor, a first electrode of which is connected to the first electrode of the fourth compensating transistor, and a second electrode of which is connected to the second electrode of the fourth compensating transistor;

a signal outputted from the first electrode of the third compensating transistor is the compensating control signal; and the first electrode of the third compensating transistor is connected to the second electrode of the driving transistor.

2. The pixel circuit according to claim 1, wherein:

each of the row pixel units comprises a plurality of subpixel units;

each of the subpixel units comprises the subpixel driving circuit and the OLED;

each of the row pixel units comprises the auxiliary compensating circuit; and the output end of the auxiliary compensating circuit is connected to each subpixel driving circuit of each of the row pixel units via a scanning line.

3. The pixel circuit according to claim 1, wherein:

the auxiliary compensating circuit is arranged outside of an effective display region of the OLED display panel; and the subpixel unit is arranged within the effective display region of the OLED display panel.

4. A pixel circuit driving method for use in the pixel circuit according to claim 1, comprising:

at an initial light-emitting state, a driving control signal is a high level signal, a resetting control signal is a high level signal, a scanning signal is a low level signal, a compensating control signal generated by an auxiliary compensating circuit is a high level signal, a switching control signal generated by the auxiliary compensating circuit is a low level signal, a data writing-in transistor is turned off, a potential at a gate electrode of a driving transistor is a voltage stored in a previous frame, and an OLED emits light;

at a resetting stage, the driving control signal is a low level signal, the resetting control signal is a high level signal, the scanning signal is a high level signal, the compensating control signal generated by the auxiliary compensating circuit is a low level signal, the switching control signal generated by the auxiliary compensating circuit is a high level signal, a reference voltage on a data line is written into the gate electrode of the driving transistor, the driving transistor is turned on, and a potential at an anode of the OLED is reset to be at a low level, and the OLED does not emit light;

at a compensating stage, the driving control signal is a high level signal, the resetting control signal is a high level signal, a scanning signal is a high level signal, the compensating control signal generated by the auxiliary compensating circuit is a high level signal, the switching control signal generated by the auxiliary compensating circuit is a high level signal, the reference voltage on the data line is written into the gate electrode of the driving transistor, a potential at a source electrode of the driving transistor gradually increases to a value obtained by subtracting a threshold voltage of the driving transistor from the reference voltage on the data line to compensate for the threshold voltage of the driving transistor with a gate-to-source voltage of the driving transistor, and the OLED does not emit light;

at a data writing-in stage, the driving control signal is a low level signal, the resetting control signal is a low level signal, the scanning signal is a high level signal, the compensating control signal generated by the auxiliary compensating circuit is a floating signal, the switching control signal generated by the auxiliary compensating circuit is a high level signal, a data voltage is written into the gate electrode of the driving transistor, the driving transistor is turned on, and the OLED does not emit light; and at a light-emitting stage, the driving control signal is a high level signal, the resetting control signal is a high level signal, the scanning signal is a low level signal, the compensating control signal generated by the auxiliary compensating circuit is a high level signal, the switching control signal generated by the auxiliary compensating circuit is a low level signal, a voltage difference between two ends of a first capacitor remains unchanged to maintain the gate-to-source voltage of the driving transistor as unchanged, and the driving transistor is turned on to drive the OLED to emit light.

5. An OLED display panel comprising a pixel circuit, wherein:

the pixel circuit comprises a plurality of row pixel units;

one of the row pixel units comprises a plurality of subpixel units;

one of the subpixel units comprises a subpixel driving circuit and an OLED;

the subpixel driving circuit comprises a driving transistor connected to the OLED and a driving control module, which is connected to a data line and the driving transistor;

the one of the row pixel units further comprises an auxiliary compensating circuit;

an input end of the auxiliary compensating circuit is connected to a gate driving circuit of the OLED display panel via an auxiliary scanning line;

an output end of the auxiliary compensating circuit is connected to the subpixel driving circuit of the one of the row pixel units via a scanning line;

the auxiliary compensating circuit is configured to generate a switching control signal inputted to the subpixel driving circuit according to a scanning signal from the gate driving circuit, and generate a compensating control signal inputted to the subpixel driving circuit according to a control signal from the gate driving circuit;

the subpixel driving circuit is configured to receive a data voltage from the data line accordance to the switching control signal, control the driving transistor to drive the OLED to emit light according to the data voltage, and compensate for a threshold voltage of the driving transistor according to the compensating control signal when the driving transistor drives the OLED to emit light;

a driving power receiving end of the auxiliary compensating circuit is connected to a driving power signal line;

a resetting power receiving end of the auxiliary compensating circuit is connected to a resetting power signal line;

the auxiliary compensating circuit is configured to generate the compensating control signal according to a driving voltage signal from the driving power signal line, a resetting voltage signal from the resetting power signal line and the control signal from the gate driving circuit;

the driving power signal line and the resetting power signal line are both arranged outside of the effective display region of the OLED display panel;

a first electrode of the driving transistor is connected to an anode of the OLED;

a second electrode of the driving transistor is configured to receive the compensating control signal;

a cathode of the OLED is configured to receive a cathode potential;

the driving control module comprises a data writing-in transistor, a gate electrode of which is configured to receive the switching control signal, a first electrode of which is connected to the data line, and a second electrode of which is connected to a gate electrode of the driving transistor, a first capacitor, one end of which is connected to the gate electrode of the driving transistor, and another end of which is connected to the first electrode of the driving transistor, and a second capacitor connected between the anode and the cathode of the OLED;

the control signal comprises a driving control signal and a resetting control signal;

the resetting control signal is delayed by two clock periods relative to the driving control signal;

the auxiliary compensating circuit comprises a switching control signal generating circuit and a compensating control signal generating circuit;

the switching control signal generating circuit is configured to directly use the scanning signal from the gate driving circuit as the switching control signal inputted to the gate electrode of the data writing-in transistor;

the compensating control signal generating circuit comprises a first compensating transistor, a gate electrode of which is configured to receive the driving control signal, and a first electrode of which is configured to receive the resetting voltage signal, a second compensating transistor, a gate electrode of which is connected to a second electrode of the first compensating transistor, and a first electrode of which is configured to receive the resetting voltage signal, a third compensating transistor, a gate electrode of which is configured to receive the driving control signal, a first electrode of which is connected to a second electrode of the second compensating transistor, and a second electrode of which is configured to receive the driving voltage signal, a fourth compensating transistor, a gate electrode of which is configured to receive the resetting control signal, a first electrode of which is connected to the gate electrode of the second compensating transistor, and a second electrode of which is configured to receive the resetting control signal, and a fifth compensating transistor, a gate electrode of which is connected to the gate electrode of the second compensating transistor, a first electrode of which is connected to the first electrode of the fourth compensating transistor, and a second electrode of which is connected to the second electrode of the fourth compensating transistor;

a signal outputted from the first electrode of the third compensating transistor is the compensating control signal; and the first electrode of the third compensating transistor is connected to the second electrode of the driving transistor.

6. An OLED display device comprising the OLED display panel according to claim 5.

7. The OLED display panel according to claim 5, wherein:

each of the row pixel units comprises a plurality of subpixel units;

each of the subpixel units comprises the subpixel driving circuit and the OLED;

each of the row pixel units comprises the auxiliary compensating circuit; and the output end of the auxiliary compensating circuit is connected to each subpixel driving circuit of each of the row pixel units via a scanning line.

8. The OLED display panel according to claim 5, wherein:

the auxiliary compensating circuit is arranged outside of an effective display region of the OLED display panel; and the subpixel unit is arranged within the effective display region of the OLED display panel.

* * * * *